US005897457A

United States Patent [19]

Mackovjak

[11] Patent Number: 5,897,457

[45] Date of Patent: Apr. 27, 1999

[54] ATHLETIC PERFORMANCE MONITORING SYSTEM

[76] Inventor: Paul Mackovjak, 8602 Esslinger Ct., Huntsville, Ala. 35802

[21] Appl. No.: 08/641,158

[22] Filed: Apr. 29, 1996

Related U.S. Application Data

[63] Continuation-in-part of application No. 08/489,224, Jun. 12, 1995, abandoned.

[51] Int. Cl.[6] ..... A63B 69/00

[52] U.S. Cl. ..... 482/8; 482/1; 482/3; 482/15; 482/901; 73/379.01

[58] Field of Search ..... 482/1–9, 900–902, 482/14, 15; 73/379.01

[56] References Cited

U.S. PATENT DOCUMENTS

| | | | |
|---|---|---|---|
| 4,371,945 | 2/1983 | Karr et al. | 482/901 |
| 4,774,679 | 9/1988 | Carlin | 482/8 |
| 5,401,224 | 3/1995 | Tsuchiya et al. | 482/8 |

OTHER PUBLICATIONS

Impulse Sports Training Systems, Inc., "IMPAX" models 120, 220,330, 420 (Marketing Brochures).

*Primary Examiner*—Glenn E. Richman
*Attorney, Agent, or Firm*—Veal & Associates

[57] ABSTRACT

An athletic performance evaluation device utilizes ultrasonic sensing circuitry or infrared sensing circuitry, a vibration sensitive switch, and an audio input to signal a microprocessor to start a timing function that calculates therefrom an objective evaluation of the athlete's performance. A light emitting diode (LED) may be included in the apparatus to signal the athlete to begin performance while simultaneously starting the timing function. The vibration sensitive switch may be placed on the ground adjacent to a selected position on which the athlete stands to stop the timing function. In operation, the athlete jumps and the ultrasonic sensor signals the microprocessor to begin the timing function and the vibration sensor sends a second signal to stop the timing function when the athlete lands again. The interval between signals is used in distance formula $h=g(I/2)^2/2$ to determine the height attained and a display is provided for a human sensible output to show the athlete or evaluation personnel the height of the jump. The measurement is based solely on time; thus, each jumper is equally evaluated. In a response-time measurement mode, an audible input to a microphone signals the microprocessor to being the measurement and is simultaneously heard by the athlete. Ultrasonic sensing circuitry adjacent to a selected finishing position signals the microprocessor when the athletes passes through an ultrasonic beam. Alternatively, the LED may signal the athlete to begin performance which simultaneously starts the timing function. In the audible input mode, the microprocessor compensates for the delay in time required for the audible signal to reach the athlete. Various types of sensors are anticipated in the device to start and stop the timing function.

27 Claims, 4 Drawing Sheets

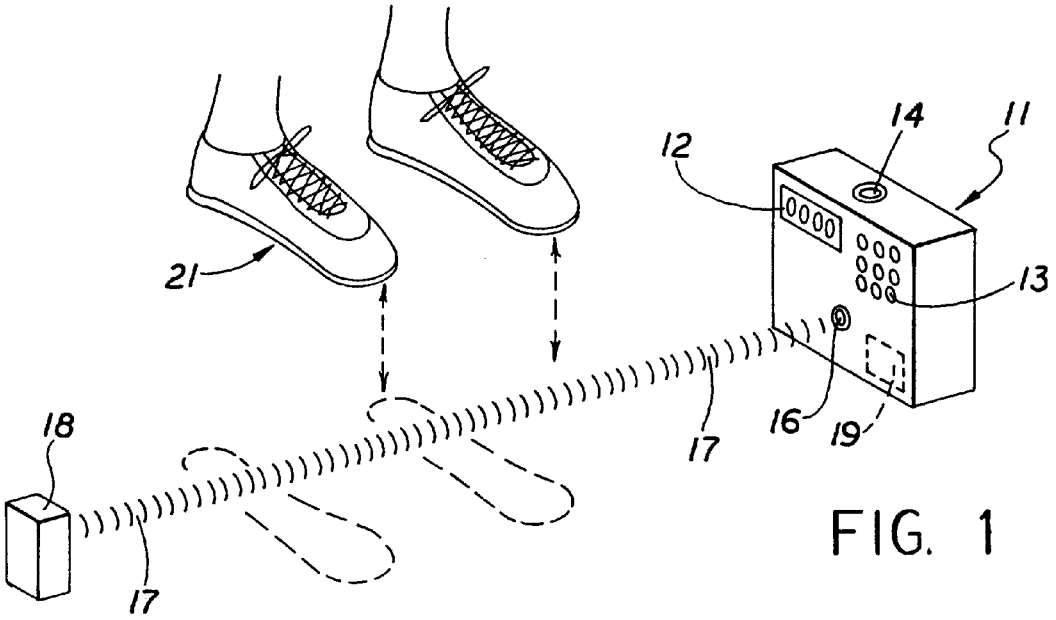
FIG. 1
FIG. 2
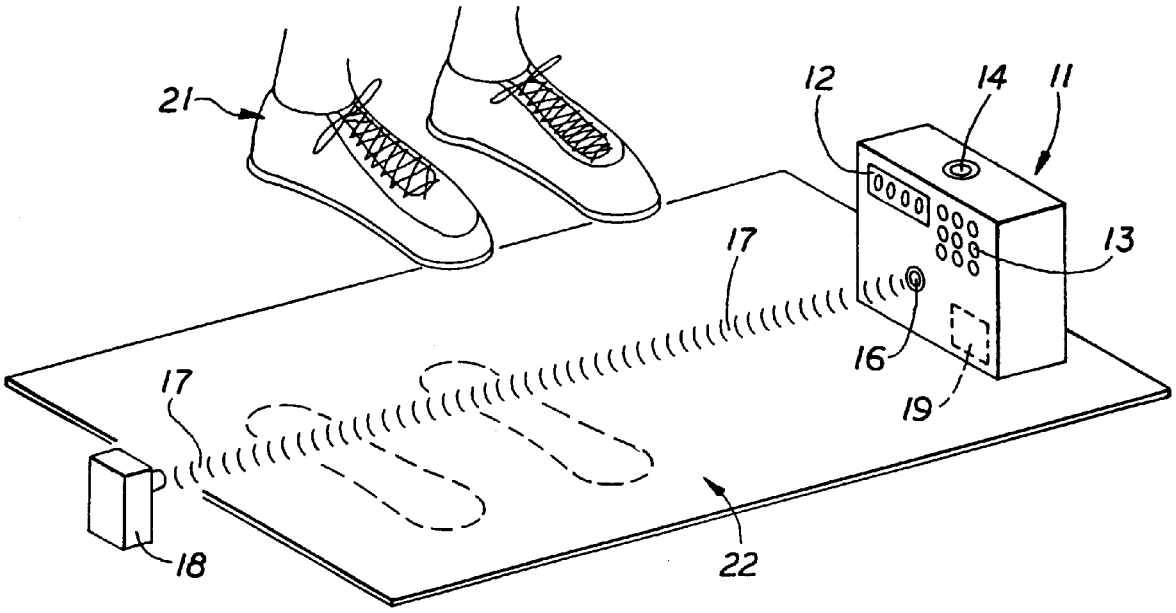

U S A
START
41
120 FEET
24
11
12
17
18
17
40
42
FINISH
40 YARDS

ATHLETIC PERFORMANCE MONITORING SYSTEM

This is a continuation-in-part of application Ser. No. 08/489,224, filed Jun. 12, 1995, now abandoned.

FIELD OF THE INVENTION

The present invention relates to the field of athletic training devices and, more particularly, to the type of devices used to measure the performance of an athlete during a particular activity. More specifically, the present invention determines the time lapse between the athletes presence being sensed and calculates a performance value, such as jump height, leg power, or time over an interval after a signal is given.

BACKGROUND

Athletes and coaches are constantly concerned with performance enhancement and means for determining whether performance has been improved. Likewise, as an evaluation tool recruiters and coaches are interested in performance evaluation. The venerable stop watch remains a coach's primary ally in determining speed over a distance; however, there are a number of performance parameters which are measurable in much smaller increments than normally attainable with a stop watch or are not measurable with sufficient accuracy with a stop watch. Among these are the vertical jump ability of an athlete, the response time to a signal, and the explosive leg power of an athlete. There have been devices in the past which measure vertical jump by requiring the athlete to touch a standard as he jumps; however, often times the touch does not occur at the zenith or does not occur at full extension of the arm, thus the vertical jump measurement is often somewhat inaccurate. Likewise, response time has heretofore been measured by visual observation, which introduces the physical limitations of the observer and is inaccurate. Other systems have been devised using photosensors and cameras; however, such systems are unduly costly and sometimes difficult to use in particular lighting situations.

Explosive leg power is a factor in the ability of the athlete to perform repeated jumping motions to a maximum height in a minimal time. In basketball parlance, how much air time can the player sustain around the rim?

To date, I am unaware of any device which can evaluate the athletes performance in terms of speed, jump height, explosive leg power, and reaction time.

SUMMARY OF THE INVENTION

It is the object of the present invention to provide an evaluation tool to enable the athlete or coach to simply and accurately measure an athlete's performance in selected quantifiable skills.

It is another object of the invention to enable a coach to quickly evaluate a plurality of athletes in the same skill without introducing an observer's bias or inaccuracy.

A further object of the invention is to provide a training aid that allows an athlete to measure his own performance without need for a spotter or observer.

These and other advantages and benefits to be derived from the invention are accomplished through the measurement of time and the sensing of an athlete's presence at a particular location. In summary, the invention includes two primary modes; a jump height mode and a response-time mode. Each of these modes may incorporate additional sub-modes depending upon the programming of the microprocessor memory. The invention incorporates a vibration sensitive switch and an ultrasonic receiver/sensor inside the main hand-held control module. The invention also includes a microphone for picking up a strong audio signal such as a starter's gun or a referee's whistle, and a high luminosity light emitting diode (LED) for signaling initiation of performance. In the jump height mode, the control module is placed adjacent to a selected position where an athlete stands. When the athlete jumps above the floor surface the vibration switch provides a signal to the microprocessor and when he lands again a second signal is sent. Alternatively, the athlete ultrasonic sensor receives a beam from a separate ultrasonic transmitter placed opposite from the control module relative to the athlete's selected position. Initially, the athlete stands in line with the beam thereby breaking it. When the athlete jumps above the selected floor position surface, the ultrasonic beam is reestablished by the athlete's movement and a signal is sent to the microprocessor starting a timer. The vibration sensor then signals the microprocessor when the athlete lands. The interval between signals is used in distance formula $h=g(I/2)^2/2$ to determine the height attained and a display is provided for a human sensible output to show the athlete or evaluation personnel how high he went. The measurement is based solely on time; thus, each jumper is equally evaluated. In the response-time mode, an audible input to the microprocessor via the microphone begins the measurement and is simultaneously heard by the athlete who thereafter attempts to reach a selected area scanned by a sensor to stop the time measurement. Alternatively, the light emitting diode signals the athlete to attempt to reach the selected area which also starts the microprocessor. The selected area is monitored by the ultrasonic beam as in the jump mode, but in this mode the athlete breaks the beam thereby sending a signal to the microprocessor to stop timing. Measurement in this way gives a qualitative measure of reaction time. Additional adaptations and uses of the apparatus will be discerned by a study of the description of the preferred embodiments and the accompanying drawings.

BRIEF DESCRIPTION OF THE DRAWINGS

Apparatus embodying features of my invention are depicted in the drawings appended hereto which form a portion of this disclosure and wherein:

FIG. 1 is a perspective view of a jump height embodiment of the invention incorporating an ultrasonic sensor to signal departure of the athlete from the floor surface and a vibration sensor within the unit positioned adjacent to the athlete's performance position to determine landing;

FIG. 2 is a perspective view of a jump height embodiment of the invention incorporating an ultrasonic sensor to signal departure of the athlete from a mat and a vibration sensor within the unit positioned adjacent to the athlete's performance position but placed upon the mat to facilitate vibration transmission;

DESCRIPTION OF THE PREFERRED EMBODIMENTS

Figure 3:
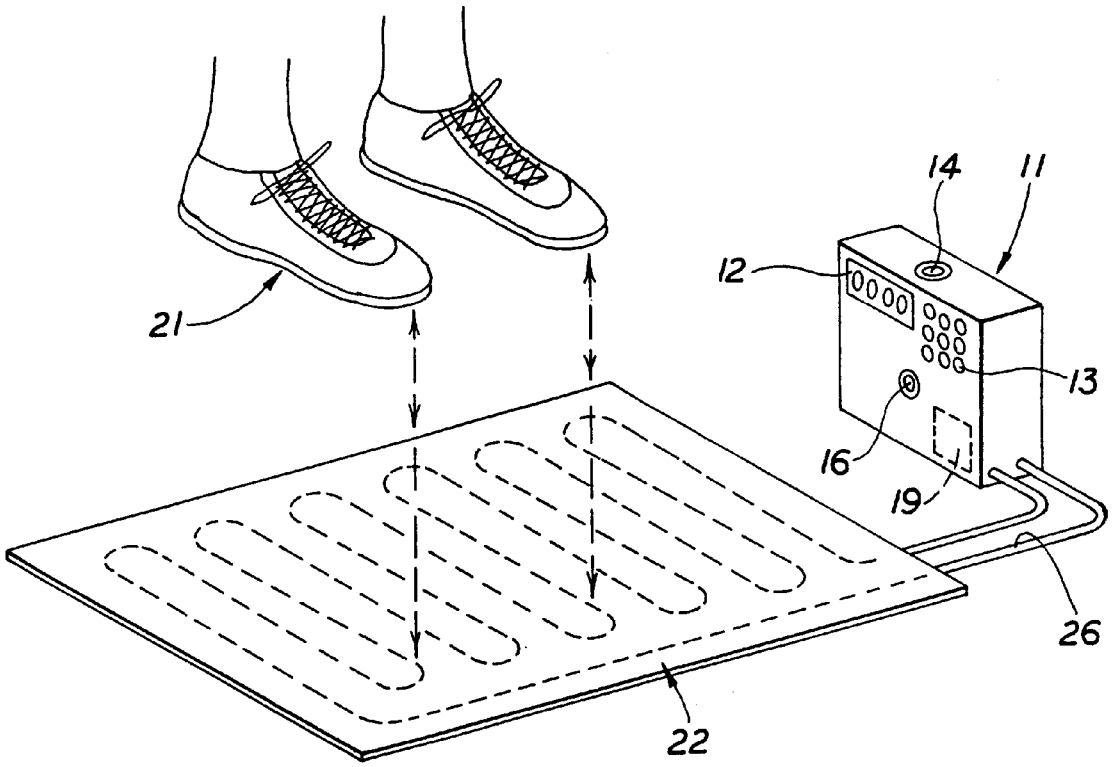
FIG. 3 is a perspective view of a embodiment of the invention using ultrasonic pulse tubes to signal departure and arrival of the athlete upon a mat.

Referring to the drawings for a clearer understanding of the invention, it will be appreciated from FIGS. 1–3 that the invention can incorporate various types of sensors to accomplish its objective calculations of an athlete's performance. In a typical configuration, control unit 11 incorporates a display 12, a user interface 13 having at least two switches, a microphone 14, an ultrasonic or infrared receiver 16, and an ultrasonic or infrared transmitter 18. It should be appreciated that transmitter 18 may be incorporated within control unit 11 (see FIG. 3) or left external with its own power supply as shown in FIGS. 1–2. If the transmitter is incorporated within the control module, a changing reflection pattern, as is well known in the art, will provide the triggering agent rather than breaking a beam as depicted. FIG. 1 shows the invention used for measuring jump height. Sensor 16 receives a signal from transmitter 18, which provides a means for detecting when the athlete 21 departs from the floor. Vibration sensor 19 detects the athlete's return to the ground.

FIG. 3 incorporates a hollow latex transmission tube 26 to control the direction of the ultrasonic beam into the exercise area. Although not necessary, a mat 22 may be placed over the tubing for increased sensitivity to sense departure from and landing on the selected position. Air within the latex tubing acts as a transmission medium and the tubing is adequately flexible so that an athlete's weight will act to disrupt the flow of sonic pulses through the tubing. The layout of the tubing is irrelevant to the function of the system as long as the athlete lands upon some section of the tubing to stop the flow of ultrasonic waves. An ultrasonic transceiver module, the vibration sensor, and the exercise mat are commercially available items readily purchased from electronic hobby stores, industrial electronics outlets, or exercise equipment outlets. In addition, vibration switches such as those used in car alarms are suitable sensors for indicating the beginning of activity and may be used alone or in concert with the tube based detection system.

Figure 5:
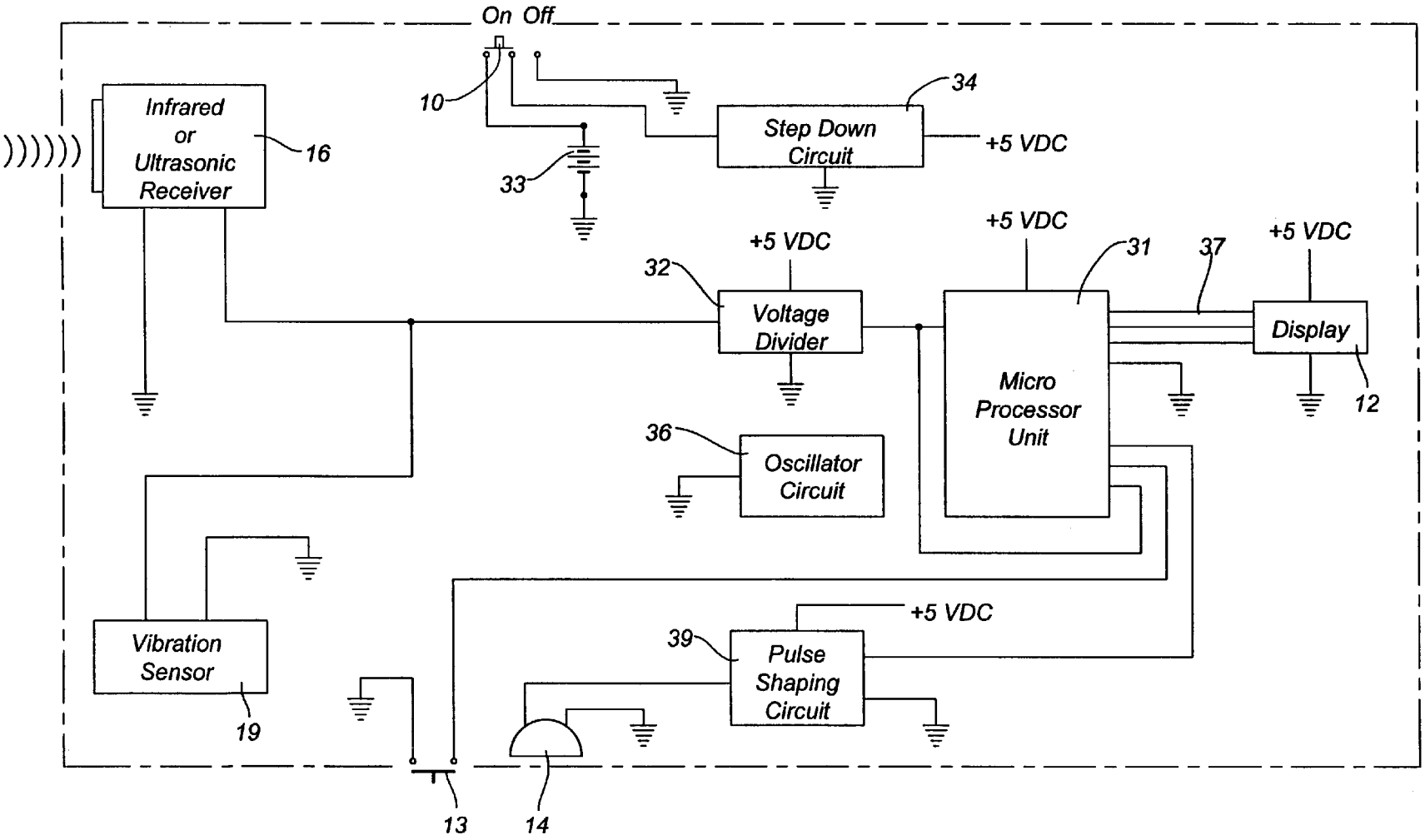
FIG. 5 is a schematic diagram of a circuit usable for the invention.

With reference to FIG. 5, note that the ultrasonic receiver 16 receives high frequency sound pulses from transmitter 18, and sends a signal to microprocessor unit 31 mounted within control unit 11, which is readily transportable. In place of the ultrasonic receiver 16, an infrared receiver may be substituted to signal the microprocessor. The receiver 16 may normally register the transmission of ultrasonic pulses as an open or closed signal, and has a circuit connection to a voltage divider 32 or similar input buffering connection configured such that the change in the state of the signal as open or closed will be supplied to the microprocessor 31 as a change in voltage level supplied to the microprocessor input. As will be noted in the schematic, secondary and tertiary sensors may also provide inputs to the microprocessor 31. Vibration sensor 19 signals the microprocessor 31 upon sensing a selected level of vibration, such as an athlete's foot fall, and microphone input 14 provides a discriminated input to the microprocessor upon sensing the sound of a starting gun or other selected sound such as a referee's whistle. Using the vibration sensor reduces the cost, weight, and size of the system since no mat with mechanical switches is required. It is also preferable to incorporate the vibration sensor into the control unit, so that no additional external components are needed.

Power is supplied to the unit by a battery 33, such as a replaceable or rechargeable 9-volt battery. A step down circuit 34 reduces the voltage level to 5 volts per standard requirements of the electronic components used in the control unit 11. On/off switch 13 connects the battery 33 to the step down circuit. A crystal or other oscillator input 36 to the microprocessor 31 provides timing synchronization.

Microprocessor 31 has a plurality of standard connections 37 to a display 12 to provide a human sensible display for evaluation of performance. The display 12 may be a LCD display with appropriate driver circuitry as is well known in the art. Additional inputs to microprocessor 31 include an on/off switch 10, a mode switch 13, and a microphone 14 connected to the microprocessor through a pulse shaping circuit 39. The specific connection and configuration of the various components in terms of pin connections, power supply, biasing voltages and the like are matters within the knowledge of fabricators of electronic controls, and a discussion of such details would not be warranted or helpful to the artisan. The present invention resides not in the details of interconnection of the components but rather in the interaction between the components and the athlete.

Referring again to FIG. 1, it may be seen that the ultrasonic transmitter 18 sends a continuous beam 17 to receiver 16 in the control unit 11. At rest, prior to any activity, the control unit display indicates in a convenient fashion that the beam is being properly received. The athlete 21 then steps into the selected area and blocks beam 17 which indicates to the microprocessor that timing is about to begin. Upon jumping, athlete 21 clears the beam 17 thereby allowing the beam 17 to reach receiver 16 and send a signal to the microprocessor 31 to start a count timer function. The athlete then lands back onto the original starting position thereby triggering vibration sensor 19 and stopping the count timer function. Alternatively, microprocessor 31 can be programmed to stop the count timer function upon a new signal from receiver 16 upon the athlete again falling through the beam 17.

Some floor surfaces do not transmit vibrations as readily as others. A typical wood gymnasium floor conducts vibrations from an athlete landing after a jump quite well. However, cement or asphalt floors tend to abate the vibrations too quickly for the vibration sensor 19 to pick-up. As shown in FIG. 2 these types of floor surfaces require a mat 22 to be placed under both the athlete 21 and the control module 11. A typical exercise mat readily transmits the athlete's landing from a vertical jump exercise so that sensor 19 can stop the count timer function.

FIG. 3 shows an embodiment of the invention in which the microprocessor 31 has been programmed to accept signals from an ultrasonic transceiver built into the control unit 11. Flexible latex tubing 26 has one end attached to an ultrasonic transmitter and the other end attached to a receiver. Transmitter and receiver may be integrated into a transceiver module and incorporated within the control unit 11 as shown. Due to the increased accuracy of sensing time of movement, the tube 26 allows for more precise sensing of an athlete's jump height. The transceiver sends a continuous ultrasonic pulse through he tubing. An athlete standing on any portion of the tubing blocks the signal until he jumps, whereupon the ultrasonic pulse propagates through the tube thereby triggering the transceiver to send a signal to the microprocessor 31 to start the count timer function. Landing again on the tubing blocks the ultrasonic path, which sends another signal to the microprocessor to stop the count function. While typically the tubing will be located underneath a conventional exercise mat, it is foreseen that a mat may be manufactured in which the tubing is integral.

Regardless of the sensor type triggering the counting function, the microprocessor computes an objective evaluation of an athlete's performance based upon a single time variable. Microprocessor 31 may be any suitable commercially available unit. The microprocessor must also include a timer such that the interval between the start and stop signal may be accurately established, a memory for holding a program, computational capabilities such that the interval may be used in the distance formula to calculate how high the athlete jumped, and an output capable of providing signals to drive an LCD or other type display 12. Alternatively, the timer and program store may be external of the microprocessor, but would require interface circuitry within the microprocessor to control these elements. A suitable microprocessor is a PIC16C58A, an 8 bit microcomputer, which includes a 2K EPROM program memory, and 80 bytes of ram. Accordingly, the microprocessor is programmed to divide the interval in half, since the athlete's jump is composed of an ascent and descent of equal duration. Thus, I/2=t in seconds in the distance formula d=acceleration * $(\text{time})^2/2$ and the microprocessor is programmed to compute jump height using $$h=g(I/2)^2/2.$$

where h is the computed height; g is the standard acceleration due to gravity of 384 inches/$\text{sec}^2$; and, I is the measured time interval.

Upon power-up via switch 10, the display 12 cycles through the three main operating modes. Two of the modes are jump modes, and the third is the performance/reaction mode. The user waits for the desired mode to appear upon the screen and toggles the switch 13 to select (see FIG. 5, switch 13).

In the first jump mode ("1 Jump"), the athlete simply jumps straight up and down. The previously discussed sensors, are used to signal the microprocessor which computes the time in the air. Using the above stated formula, the height of the jump is measured and displayed. After each jump, the microprocessor resets itself allowing for an endless succession of jump height performance measurements.

In the second jump mode ("4 Jump Mode"), a succession of jumps are computed to calculate the "explosive leg power force" (ELPF) of an athlete, particularly a basketball player. In this mode, the microprocessor 31 is programmed such that a signal from one of the selected sensors, which indicates that an athlete is at a selected position when the apparatus is turned on by power switch 10, places the microprocessor in a mode to measure the elapsed time during a series of jumps including hang time and ground time and to calculate the explosive leg force by dividing the hang time by the ground time. Each jump is quantified for height and an average height is computed using the height formula for each jump and dividing by the number of jumps. The microprocessor output to the display indicates average jump height, average ground time, and the calculated ELPF. After the 4 jumps have been evaluated, the display invites the athlete to jump 4 times again, thus an evaluator such as a coach can start the apparatus with one player on the mat, watch and record the displayed parameters manually, and immediately have the next player in a line of players step on the mat and perform the same evaluation. This may be repeated as many times as desired to evaluate a whole team or as a tryout device to evaluate a group of prospects. Likewise, when the microprocessor is in the jump mode, a number of individuals may be sequentially evaluated as to raw jump height on a single jump under identical conditions in a very short period of time. Coaches will appreciate the ability to quantify "hang time", ELPF, and raw jump height, since each of these are variable between athletes and can be used in determining how best to use or improve the athlete's skills.

The third mode of the invention addresses sprint-timing capabilities of an athlete. The dual input capability provided by microphone 14 allows the evaluation of reaction time and speed of a player. Reaction time to both sight and sound are both contemplated by the invention and addressed in sub-modes of the sprint-timing mode. Any of the configurations shown in FIGS. 1–3 may be used to measure pure reaction time in response to an audible signal. In the timer/reaction mode, selected with switch 13 (switch at bottom of FIG. 5), the microprocessor unit measures the elapsed time from an audible input 24 (see FIG. 4) via microphone 14 until the moment when the weight of the athlete is removed from a selected position causing sensor 16 to signal the microprocessor. The microprocessor measures the time from the sound input until the athlete lifts off the floor surface.

Figure 4:
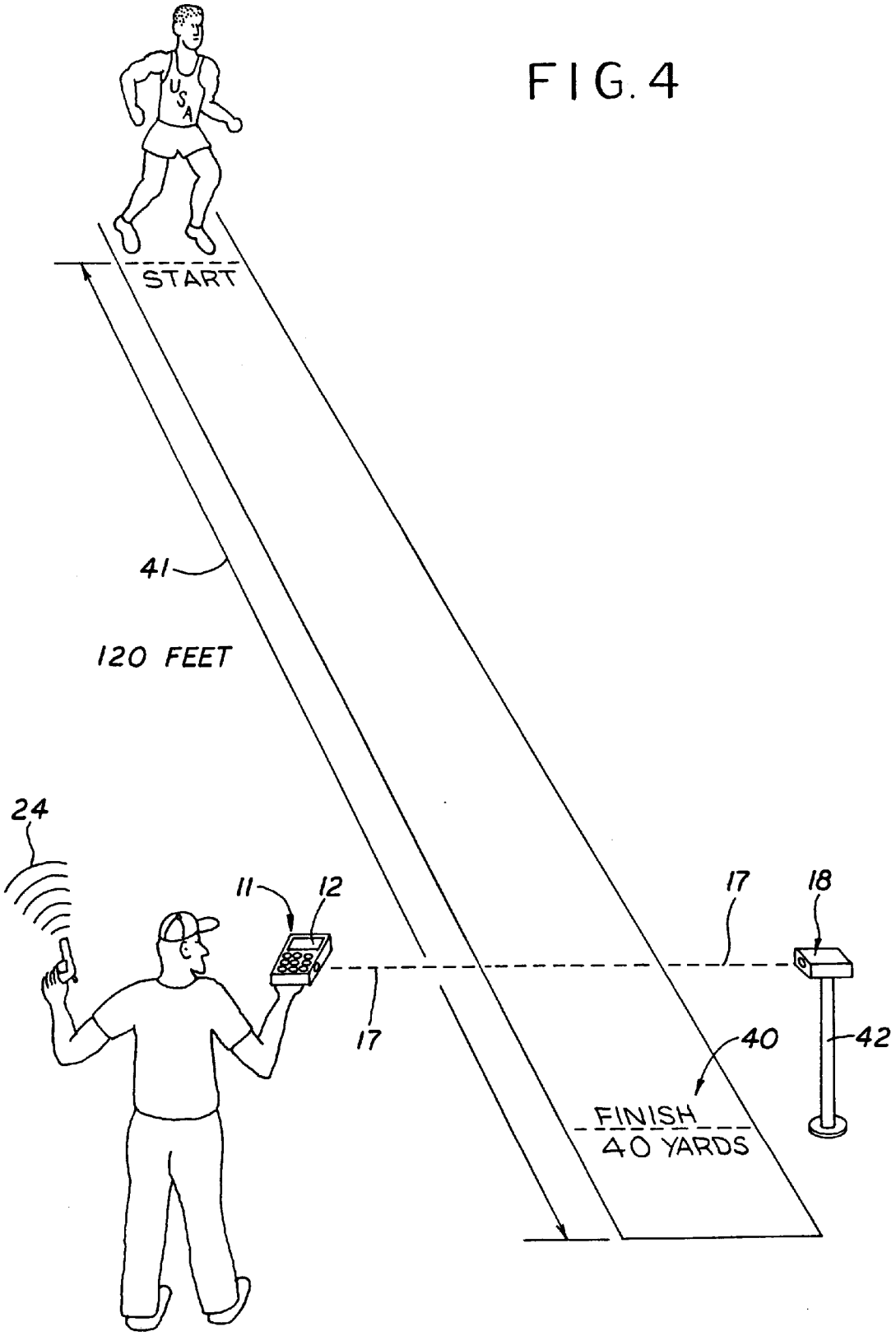
FIG. 4 is a view of the invention incorporated into a (response-timing) sprint-timing circumstance.

As shown in FIG. 4 to measure speed over a distance responsive to audible signal or a light signal, the ultrasonic sensor may be placed a measured distance from the athlete to signal when the athlete reaches a selected position. Two sub-modes "start on voice (or sound)" and "start on light" measure an athlete's response to different stimuli. Initially, the operator selects "sprint-timer mode" from the primary cycling display with switch 13, a second cycle of displays begins offering "start on voice" or "start on light" modes. The operator again selects one of these sub-modes with switch 13. After selecting the proper sub-mode, the operator is required to input the distance 41 of the performance run by momentarily pressing down on the switch 13 when the proper digit is shown on the display. An underlined cursor position itself under one of several digits on the display and the operator selects the desired digit as the position cycles from 0–9. For example, if the distance of performance is 40 yards or 120 feet, the following steps would need to be accomplished while each digit is cycling through the 0–9.

1. Wait until the left most digit of the display reads 1 then momentarily press down on the switch 13. The display will then read "DIST=100FT".

2. Wait until the second digit reads 2, then momentarily press down on the switch 13. The display reads "Ready 120FT".

This accomplishes the distance of performance input.

If the operator has selected the start on sound sub-mode, the microprocessor timer and the athlete can now be started by shouting "GO" into the microphone, or upon the input of other audio inputs such as a referee's whistle or a starter's gun. The athlete then sprints to a selected finishing area 40 and passes through an ultrasonic beam 17 the timer will stop and the display 12 will read the time to the nearest hundredth of a second. Example: 04.65 120 FT. The next athlete can be immediately be timed by providing a subsequent audible start signal. Also shown in FIG. 4, is a stand 42 upon which the ultrasonic transmitter sits. This elevated position enhances the ability for the ultrasonic receiver to pick-up the transmission beam.

Due to the delay in the speed of sound to reach the athlete, compensation in the invention must adjust the timing for the performance distance selected is start on sound mode is selected. For example, since the speed of sound is 1100 ft./second, an adjustment for a 40 yard sprint would require 120 ft/1100 ft/sec.=0.1091 sec. time adjustment (i.e. 0.1091 seconds must be subtracted from the runner's resultant finishing time). This adjustment can be readily accomplish via the programming. The unit automatically compensates for this timing compensation depending upon the mode chosen and the distance entered. It should be also clear that the control unit must be adjacent to the selected finishing position.

In the start on light sub-mode, a high power LED is momentarily illuminated on the control unit with an additional switch (not shown). The LED is pointed at the athlete and the operator triggers the timer with the switch which also illuminates the LED. The sprint distance must also be input into the unit as with the start on voice sub-mode, however no timing compensation is necessary due to the near infinitesimal time period required for the light to reach the athlete from the LED. Therefore, any programming subroutines compensating for the delay sound reaching the athlete would be deactivated. As in the start on voice mode, the athlete passes through the ultrasonic beam to stop the timer.

It will be appreciated that numerous variations in utilization of the invention are possible, as shown in FIGS. 1, 2, 3, and 4, wherein various types of sensors may serve as the start and stop initiators. Also, as discussed, a mat 22 and tubing 26 may be utilized to provide the start and stop signals to the microprocessor.

While I have shown my invention in various forms, it will be obvious to those skilled in the art that it is not so limited but is susceptible of various changes and modifications without departing from the spirit thereof.

Having set forth the nature of the present invention, what is claimed is:

1. Apparatus for measuring performance of at least one athlete comprising:

(a) ultrasonic sensor means for determining the presence of an athlete at a predetermined position, said sensor means located at said predetermined position and having an output signal indicative of the presence of said athlete at said position;

(b) computational means for correlating the presence of said athlete at said predetermined position with performance of an athletic activity by said athlete, said computational means having an input from said ultrasonic sensor means;

(c) display means operatively connected to said computational means to provide a human sensible indication of said athletic performance of said athlete; and, (d) input means operatively connected to said computational means to select a mode of computation such that various types of athletic activities may be evaluated as a function of elapsed time.

2. Apparatus as defined in claim 1 further comprising means for inputting an audible signal to said computational means to initiate said correlation of the presence of said athlete at said position and wherein said computational means is a microprocessor programmed to calculate and output a signal indicative of a time lapse between said input of said audible signal and movement of said athlete from said position.

3. Apparatus as defined in claim 1, further comprising means for inputting an audio signal to said computational means to initiate said correlation of the presence of said athlete at said position wherein said athlete is located at a second position at a distance from said predetermined position, and said computation means is a microprocessor programmed to calculate and output a signal to said display means indicative of a time lapse between said input of said audible signal and the presence of said athlete at said position, said apparatus including means to compensate for a delay in time for said audible signal to reach said athlete.

4. Apparatus as defined in claim 3, further including LED signaling means for signaling said athlete to initiate said athletic performance and for signaling said microprocessor to initiate said correlation of the presence of said athlete at said predetermined position, and wherein said means to compensate for said delay of time is deactivated.

5. Apparatus as defined in claim 1, further including LED signaling means for signaling said athlete to initiate said athletic performance and for signaling said computation means to initiate said correlation of the presence of said athlete at said position.

6. Apparatus as defined in claim 1, wherein said ultrasonic sensor means comprises:

(a) an ultrasonic pulse transmitter for generating continuous ultrasonic pulses; and, (b) an ultrasonic pulse receiver for receiving said ultrasonic pulses from said transmitter over at said predetermined position, said receiver including means for signaling said computational means upon disruption or reception of said pulses.

7. Apparatus as defined in claim 1, wherein said computational means is a microprocessor programmed to compute a height of a jump of an athlete using the formula $$h=g(I/2)^2/2$$

where h=calculation of said height;

g=acceleration due to gravity; and,

I=time elapsed between said output signal from said ultrasonic sensor means indicating movement of said athlete from said position and a subsequent signal indicating the presence of said athlete at said position, wherein said movement is a substantially vertical jump.

8. Apparatus as defined in claim 7, wherein said microprocessor is programmed to calculate and output a signal indicative of said athlete's explosive leg power as a function of height of jump and elapsed time on the ground during a series of repetitive jumps, said microprocessor including means for storing a correlation table and retrieving stored values therefrom for display.

9. Apparatus for measuring at least one athlete's performance comprising:

(a) sensing means for sensing the initiation and completion of said performance to be measured and outputting a signal responsive thereto, wherein at least said initiation or said completion occurs at a predetermined position relative to said sensing means;

(b) computational means operatively connected to said sensing means for correlating the elapsed time between initiation and completion of said performance with a value;

(c) means operatively connected to said computational means to provide a human sensible indication of said correlated value; and (d) input means operatively connected to said computational means to select a mode of computation such that various types of athletic activities may be evaluated.

10. Apparatus as defined in claim 9, wherein said sensing means includes at least one vibration sensitive switch to be actuated by movement of said athlete, an ultrasonic sensing circuit to be actuated by movement of said athlete, and at least one means for signaling the reception of an audible signal by said apparatus.

11. Apparatus as defined in claim 10, wherein said means for inputting an audible signal comprises a microphone having an output to an amplifier operatively connected to said computational means.

12. Apparatus as defined in claim 11, wherein said computational means is a microprocessor including means for interfacing with a stored program.

13. Apparatus as defined in claim 12, wherein said microprocessor is programmed to compute a height of a jump of an athlete using the formula $h=g(I/2)^2/2$ where h=calculation of said height;

g=acceleration due to gravity; and,

I=time elapsed between said output signal from said sensing means indicating movement of said athlete from said position and a subsequent signal indicating the presence of said athlete at said position, wherein said movement is a substantially vertical jump.

14. Apparatus as defined in claim 13, wherein said microprocessor is programmed to calculate and output a signal indicative of said athlete's explosive leg power as a function of height of jump and elapsed time at said selected position during a series of repetitive jumps, said microprocessor including means for storing a correlation table and retrieving stored values therefrom for display.

15. Apparatus as defined in claim 9, further comprising means for inputting an audio signal to said computational means to initiate said correlation of the presence of said athlete at said predetermined position and wherein said athlete is located at a second position a predetermined distance from said predetermined position and said computation means is a microprocessor programmed to calculate and output a signal to said display means indicative of a time lapse between said input of said audible signal and the presence of said athlete at said position, said apparatus including means to compensate for a delay in time for said audible signal to reach said athlete.

16. Apparatus as defined in claim 10, wherein said ultrasonic sensing circuit comprises:

(a) an ultrasonic pulse transmitter for generating continuous ultrasonic pulses; and, (b) an ultrasonic pulse receiver for receiving said ultrasonic pulses from said transmitter over an area where athletic movement is anticipated, said receiver including means for signaling said computational means upon disruption or reception of said pulses.

17. Apparatus as defined in claim 10, wherein said ultrasonic sensing circuit comprises:

(a) a tube for transporting ultrasonic waves;

(b) an ultrasonic pulse transmitter for generating continuous ultrasonic pulses; and, (c) an ultrasonic pulse receiver for receiving said ultrasonic pulses from said transmitter through said tube, said receiver including means for signaling said computational means upon interruption or reception of said pulses.

18. Apparatus as defined in claim 17, wherein said computational means is programmed to calculate and output a signal to said display means indicative of the time lapse between said input of said audible signal and said movement of said athlete from said tubing.

19. Apparatus as defined in claim 9, wherein said sensing means includes at least one vibration sensitive switch to be actuated by movement of said athlete, an infrared sensing circuit to be actuated by movement of said athlete, and at least one means for signaling the reception of an audible signal by said apparatus.

20. Apparatus as defined in claim 19, wherein said infrared sensing circuit comprises:

(a) an infrared beam generator for generating a continuous infrared beam; and, (b) an infrared receiver for receiving said infrared pulses from said transmitter over an area where athletic movement is anticipated, said receiver including means for signaling said computational means upon disruption of said pulses.

21. Apparatus as defined in claim 20, wherein said infrared generator and receiver are integrated into a single infrared transceiver and said disruption is an unexpected correlation between an actual infrared dispersal pattern and a reference infrared dispersal pattern, said infrared transceiver including means for signaling said computational means of said disruption.

22. Apparatus for measuring at least one athlete's performance comprising:

(a) sensing means located at a predetermined position for sensing the initiation and completion of said performance to be measured and outputting a signal responsive thereto;

(b) computational means operatively connected to said sensing means for correlating the elapsed time between initiation and completion of said performance with a value;

(c) signaling means for signaling an athlete to initiate said performance;

(d) input means operatively connected to said computational means to select a mode of computation such that various types of athletic activities may be evaluated; and, (e) means operatively connected to said computational means to provide a human sensible indication of said correlated value.

23. Apparatus as defined in claim 22, wherein said signaling means comprises a light emitting diode (LED).

24. Apparatus as defined in claim 22, wherein said sensing means includes at least one vibration sensitive switch to be actuated by movement of said athlete, an ultrasonic sensing circuit to be actuated by movement of said athlete, and at least one means for signaling the reception of an audible signal by said apparatus.

25. Apparatus as defined in claim 23, wherein said athlete is initially located at a predetermined distance from said predetermined position and said computation means is a microprocessor programmed to calculate and output a signal to said display means indicative of a time lapse between actuation of said LED and the presence of said athlete at said position.

26. Apparatus as defined in claim 23, wherein said sensing means comprises an ultrasonic sensing circuit having an ultrasonic pulse transmitter for generating continuous ultrasonic pulses and an ultrasonic pulse receiver for receiving said ultrasonic pulses from said transmitter over an area where athletic movement is anticipated, said receiver including means for signaling said computational means upon disruption or reception of said pulses.

27. Apparatus as defined in claim 26, wherein said position is located a predetermined distance from said athlete and said computation means is a microprocessor programmed to calculate and output a signal to said display means indicative of a time lapse between actuation of said LED and the presence of said athlete at said position, said presence of said athlete at said position being indicated by said ultrasonic sensing circuit.

* * * * *